US005670967A

United States Patent [19]

Sarjala

[11] Patent Number: 5,670,967

[45] Date of Patent: Sep. 23, 1997

[54] METHOD AND ARRANGEMENT FOR MECHANICAL STABILIZATION

[76] Inventor: Markku Sarjala, Kukkolankatu 12, FIN-39700, Parkano, Finland

[21] Appl. No.: 596,419

[22] Filed: Feb. 2, 1996

Related U.S. Application Data

[63] Continuation of Ser. No. 211,982, filed as PCT/FI92/00245, Sep. 21, 1992 published as WO93/08614, Apr. 29, 1993, abandoned.

[30] Foreign Application Priority Data

Oct. 21, 1991 [FI] Finland ..... 914944

[51] Int. Cl.[6] ..... H01Q 1/18; G12B 5/00

[52] U.S. Cl. ..... 343/757; 343/758; 343/763; 343/882

[58] Field of Search ..... 343/757, 758, 343/760, 761, 763, 765, 766, 878, 882; H01Q 1/18

[56] References Cited

U.S. PATENT DOCUMENTS

| | | | |
|---|---|---|---|
| 2,604,698 | 7/1952 | Ewing | 343/766 X |
| 3,747,418 | 7/1973 | Hoffman et al. | 74/5.43 |
| 3,893,123 | 7/1975 | Bieser | 343/758 X |
| 4,020,491 | 4/1977 | Bieser et al. | 343/765 |
| 4,384,294 | 5/1983 | Crook et al. | 343/765 X |
| 4,433,337 | 2/1984 | Smith et al. | 343/765 |
| 4,596,989 | 6/1986 | Smith et al. | 343/709 |
| 4,833,932 | 5/1989 | Rogers | 343/765 X |

*Primary Examiner*—Hoanganh T. Le

*Attorney, Agent, or Firm*—Pollock, Vande Sande & Priddy

[57] ABSTRACT

A method and a device are disclosed relating to the stabilization of mechanical bodies. The method is based on supporting the body to be stabilized at its mass center, whereby no acceleration in any direction causes a torque induced by the inertial forces in the body. The body thus maintains its position in relation to the earth gravity field, even if accelerations and various kinetic states were effective at the point of support. Inching of the body from the desired position is compensated by a slow control system using actuators functioning on a contact-free principle. As a particularly advantageous embodiment, the invention can be applied for stabilizing bodies attached to moving objects.

22 Claims, 7 Drawing Sheets

METHOD AND ARRANGEMENT FOR MECHANICAL STABILIZATION

This application is a continuation of U.S. patent application Ser. No. 08/211,982, filed as PCT/FI92/00245, Sep.21, 1992, published as WO93/08614, Apr. 29, 1993 now abandoned.

BACKGROUND OF THE INVENTION

The invention relates to a method according to the introductory part of claim 1 for stabilization of a mechanical body irrespective of the movements of the bearer. Using the method of the invention, the body remains and can be maintained at a desired position in relation to the earth gravity field, although the bearer carrying the body is tilted and/or moves in different directions. An embodiment in which application of the method is very useful, is the satellite antenna of a ship.

In current practice, mechanical stabilization is in most cases performed in a way that the total torque induced by the inertial forces caused by the body in its bearer and the movements of the bearer is eliminated by various actuators in a way that the body remains in a desired position. The position of the body at each time is measured in relation to the earth gravity field, and a deviation from the desired position is corrected by operating the actuators for eliminating the deviation.

A problem with this method is the limited rate of stabilization. As the rates of acceleration and the kinetic velocities of the bearer exceed the maximum response rate of the actuator and its control devices, the body is moved from the desired position. Furthermore, the expensive cost of actuators and detectors limits the field of use of stabilization.

Another currently used method of stabilization is based on utilizing the gyratory force maintaining the position of the rotation axis of a balancing wheel. The body is thus supported above its mass center, whereby the body is gravitated into the desired position. Problems with this method include the change in position caused by high acceleration rates sideways as well as turning of the gyroscopic axis caused by the accelerations directed to the gyroscope.

SUMMARY OF THE INVENTION

The purpose of this invention is to remove the disadvantages presented above to a high degree and thus raise the level of prior art in the field. For achieving this purpose, the method of the invention is mainly characterized in that the body is supported substantially and effectively at its mass center in a way that the total torque induced by the inertial forces caused by accelerations effective on the body is eliminated, the kinetic state of the body and/or the support base is measured for maintaining the position of the body in relation to the earth gravity field and for removing the effect of forces, particularly friction, changing the position of the body, and that on the basis of the measuring results, the position of the body is maintained by forces acting substantially and effectively on a contact-free principle which forces are generated on the basis of the measuring results when needed.

Firstly, the method of the invention is thus based on supporting the active body to be stabilized, such as a satellite antenna, at its mass center or close to its mass center with minimized friction. In practice, this is not often possible, particularly in applications for satellite antennas, and the mass center can therefore be transferred to a point which is suitable for applying the method and particularly required by the uses of the active body by providing the active body with at least one counterweight. The integrated body can thus be supported by a support frame connected to the bearer, whereby the mass center of the integrated body is elevated from the surface of the bearer. The integrated body being thus supported, the total torque induced by the inertial forces caused by accelerations in all directions in the integrated body is eliminated. In this context, the integrated body refers to a combination which, due to practical requirements, is composed of an active body, such as a satellite antenna, the direction of which must be maintained at the level of precision of less than one degree towards the satellite direction irrespective of movements of the bearer, and of one or several counterweights structurally required for achieving the uses of the active body.

Secondly, the method of the invention is based on the fact that although the body is supported at the mass center or close to it with minimized friction, forces are induced at the bearing point by friction, Coriolis force and the like which tend to change the position of the body; that is the method is used for correcting the inching, or creeping, which tends to change the position of the body. This is achieved by using forces which are induced on the contact-free principle. The contact-free principle is defined as the effect of forces caused by the movement of a fluidized medium, a change in an electromagnetic field, a change in relative position and/or a change in kinetic energy. This is particularly advantageous because, after correcting the position of the body, the effect of forces changing the position of the body being eliminated, the body is subjected to no support reactions caused by actuators used for the correction which would affect the position of the body, for example by forces of support reactions between the body and the bearer. As the force is acting on the basis of the contact-free principle, in which the effect of forces tending to change the position of the body by causing creeping of the body one eliminated, a force caused by the movement of a fluidized medium, a force induced by a change in the electromagnetic field, or a force based on the change in the relative position and/or in the kinetic energy, particular a rotating means placed in connection with the body, such as a balancing wheel, can be used. The forces presented above, induced on the contact-free principle when needed, do not induce forces of support reactions between the body and the bearer when it is not necessary to use the said forces to change the position of the body, for example, for eliminating the effect of friction (forces caused by the support bearings of the bearing point) and Coriolis force. In particular, the fluidized medium refers in this context to fluids, gases and/or particles brought by at least one actuator connected to the body into a kinetic state in which the correction of the position of the body is carried out by forces induced by changes in the kinetic state of the fluidized medium. Consequently, the body is subjected to a reaction force and/or a collision force induced by the kinetic state of the fluidized medium. A particularly advantageous medium is air.

Thus, the method of the invention makes it possible to use a so-called slow control system, whereby the stabilizing devices applying the method are considerably less expensive to manufacture than the present systems which are based on the utilization of active actuators of different types. The slow control system corrects the creeping of the position of the body by controlling the function of the actuators in a way that the correction of the position is achieved. The slow control system refers in this context to a system with a response rate which is at least one decade lower than the maximum kinetic velocity of the support frame. For example, if the frame of a ship rolls max. 2°/s around its longitudinal axis, the response rate of the slow control system is smaller or equal to 0.2°/s.

The invention is also related to an arrangement for applying the method.

BRIEF DESCRIPTION OF THE DRAWINGS

In the following explanation, the method of the invention is illustrated in detail with reference to the embodiments shown in the appended drawings. In the drawings.

DETAILED DESCRIPTION OF THE PREFERRED EMBODIMENTS

Figure 1:
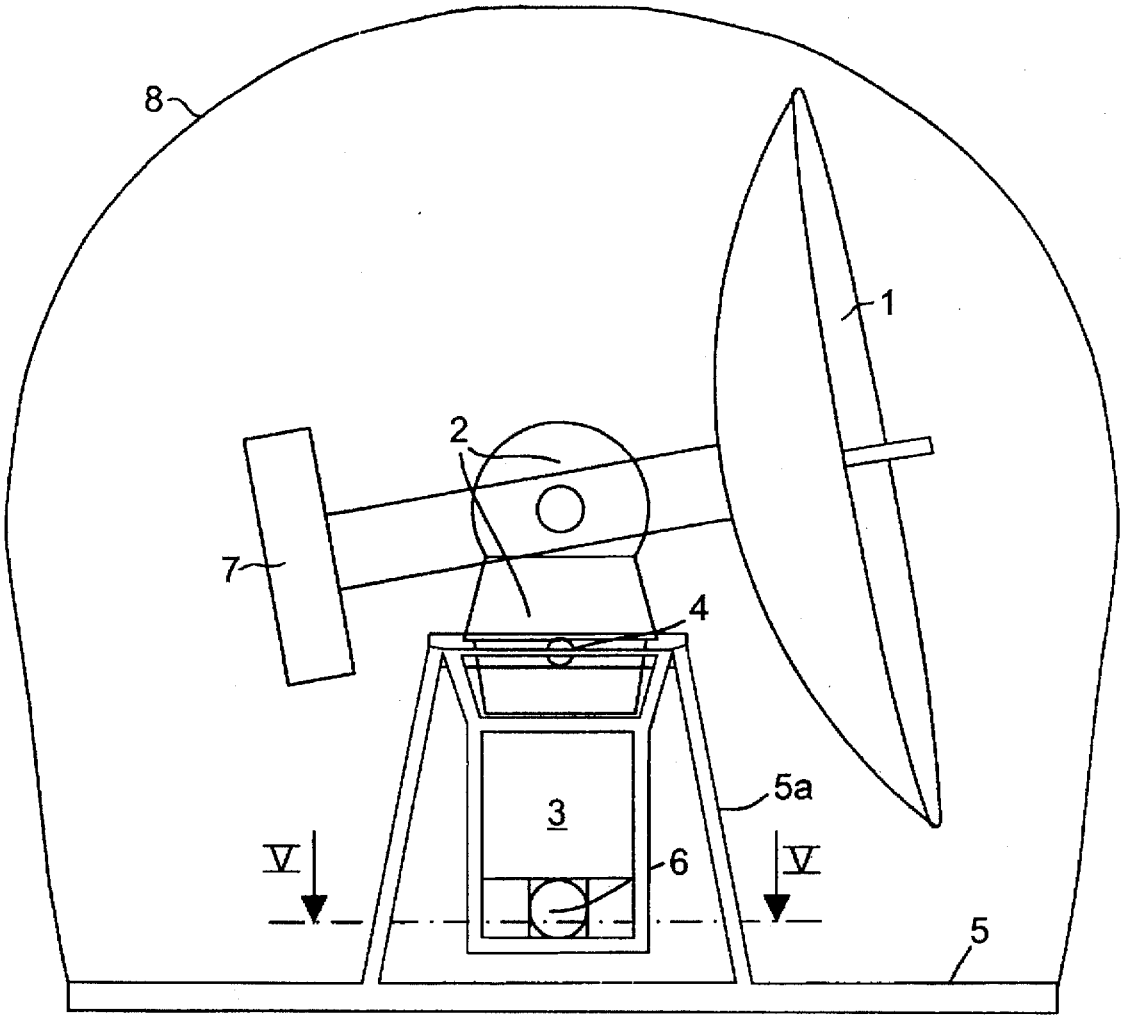
FIG. 1 shows a schematic side view of an embodiment of the method according to the invention for stabilizing a satellite receiving antenna in a ship.

FIG. 1 shows schematically an antenna arrangement 1 to be mounted on a ship 5 as the support base and forming the active body, particularly a TV satellite receiving antenna. Connected thereto is a rotating mechanism 2 for turning and tilting the antenna arrangement 1. Further, a counterweight 7 is connected to the antenna arrangement 1 in a way that the mass center of the integrated body is not changed as a result of rotating and tilting required by the function of the antenna 1. A counterweight 3 is fixed to the active body which is composed of parts 1, 2 and 7 and to be stabilized. The integrated body 1, 2, 7, 3 thus formed is supported at its mass center by support 4 with small friction on a support frame 5*a* fixed on the deck of the ship 5 in a way that the mass center and the bearing point is placed substantially and effectively above the deck of the ship 5 in a way that the counterweight 3 is at its lower part apart from the deck of the ship 5. The support is made so that the operational body, particularly the antenna arrangement 1 maintains its direction with the horizontal heading line of the ship 5. In other respects, the support allows the free turning of the body in relation to the support frame 5*a* and thus to the ship 5.

Figure 3:
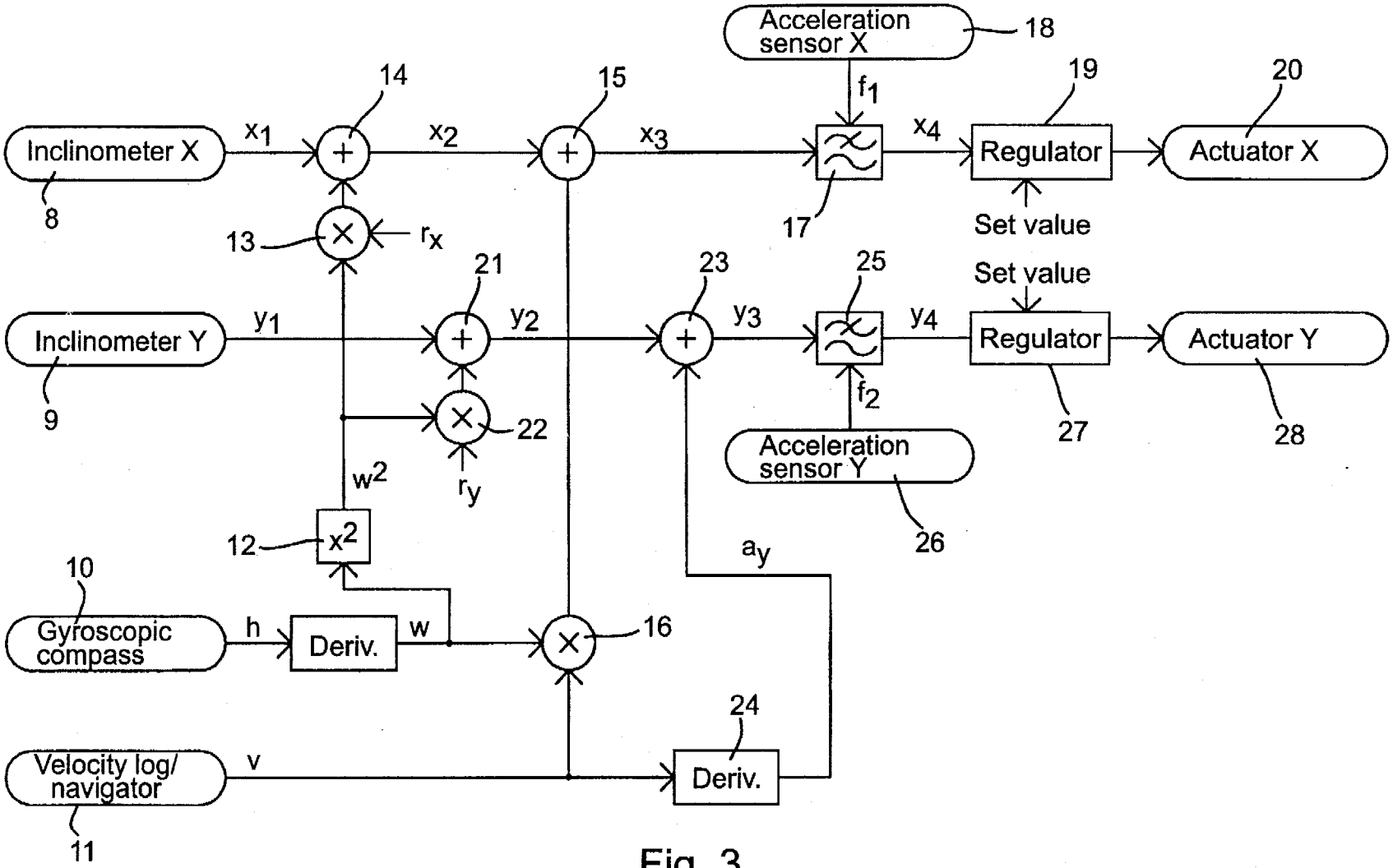
FIG. 3 shows an embodiment for a schematic diagram of the control system of actuators functioning on the contact-free principle and placed in the satellite receiving antenna.
Figure 4:
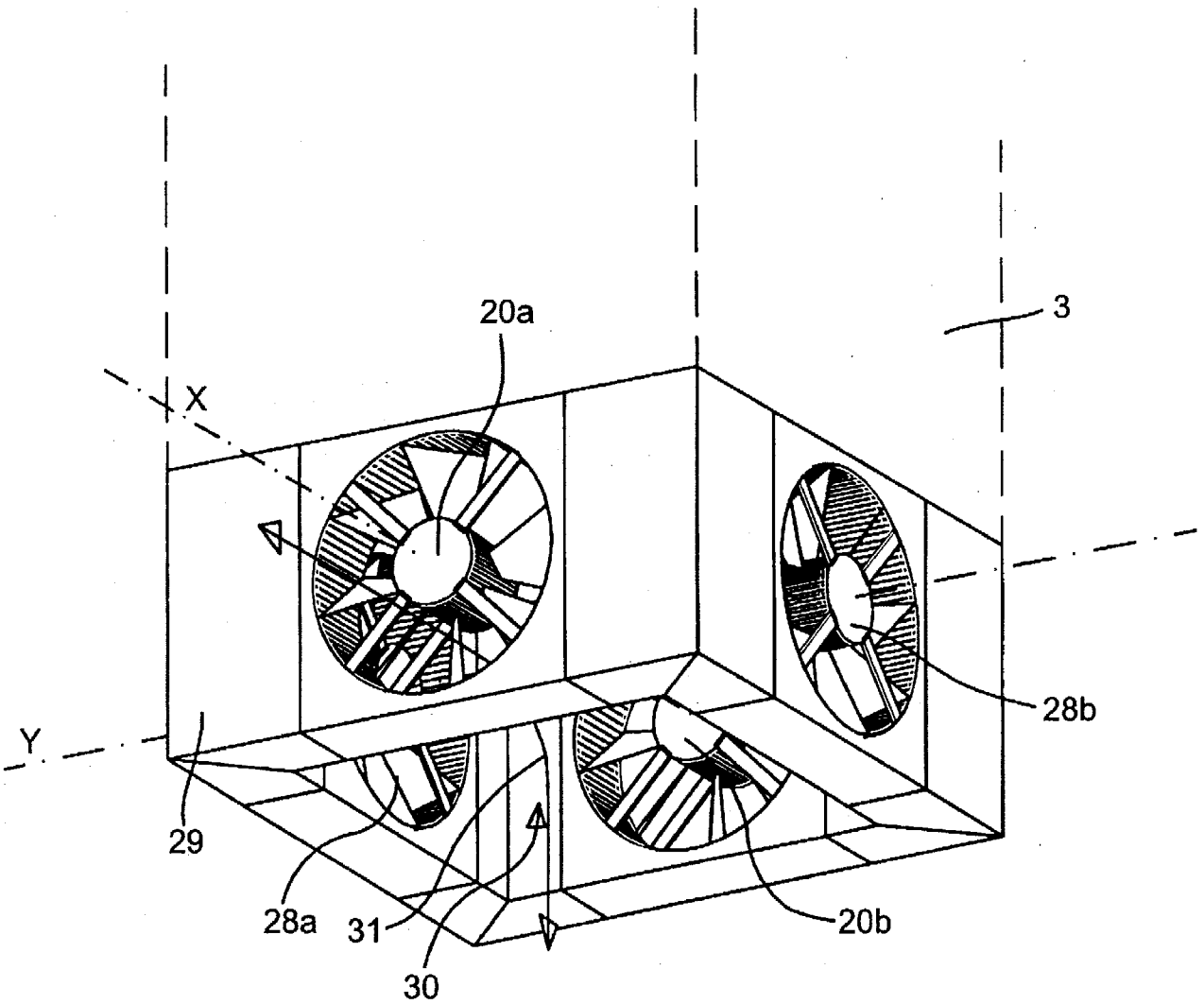
FIG. 4 shows an example of a fan arrangement placed in connection with the counterweight of the satellite antenna shown in FIG. 1, whereby the force induced by a change in the kinetic state of a fluidized medium, in this case air, is generated for eliminating the effect of forces tending to change the position of the body (satellite antenna)

Creeping of the position of the integrated body caused by friction, Coriolis force or for other reasons, such as a change of the position of the active body 1, 2 and 7 in relation to the integrated body, is corrected by actuators 6 connected to the slow control system (FIG. 3), in this embodiment (FIG. 1) by fans arranged in connection with the counterweight 3, particularly in its lower part, as shown in FIG. 4.

Figure 2:
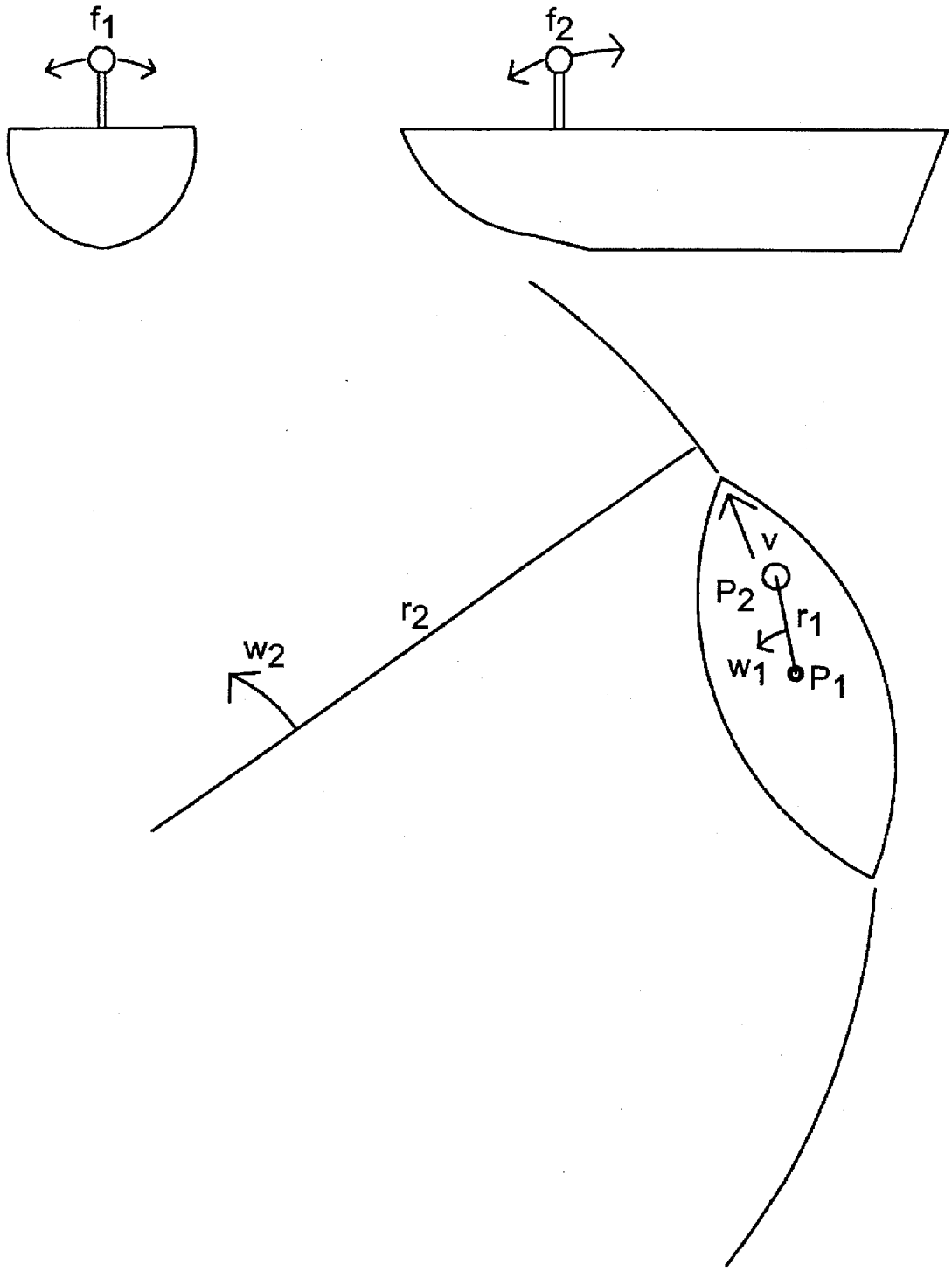
FIG. 2 shows schematically different kinetic states of a ship, particularly in a situation of placing the satellite receiving antenna as shown in FIG. 1, for illustrating the forces effective on the satellite receiving antenna.

For eliminating the effect of wind loads, the integrated body 1, 2, 7, 3 and its support frame 5a are mounted inside a fairing, a so-called radome 8 being part of the support base and/or mounted thereto. The placing of the whole construction described above, that is the arrangement shown in FIG. 1, in the ship 5, is illustrated in FIG. 2 with reference $p_2$, whereby FIG. 2 also shows the forces effective on the integrated body 1, 2, 7, 3 which are caused by the movements of the ship 5.

It is known that the ship 5 is in several different kinetic states simultaneously. In the crosswise direction, the ship rolls with a certain natural frequency $f_1$. This movement causes crosswise accelerations which are repeated at the natural frequency. The ship rolls also in the longitudinal direction with a natural frequency $f_2$. This movement causes accelerations which are repeated at the frequency $f_2$.

When the ship turns in place around a point $p_1$ at an angular velocity $w_1$, this results in a centrifugal acceleration $w_1^2 r_1$ at the point of placing of the antenna 1, where $r_1$ is the distance between the points $p_1$ and $p_2$.

When the ship 5 travels on a curved line (with radius $r_2$) at a constant velocity, the momentary standard acceleration in relation to the line is $w_2 v$, in which $w_2$ is the angular velocity of the ship and v is the cruising speed of the vessel.

A change in the speed of the ship 5 results in an acceleration/deceleration $a_y$ parallel to the course of the ship.

The schematic diagram of the control system is shown in FIG. 3. The position of the body to be stabilized (in this case, of the integrated body 1, 2, 7, 3 in connection of the ship 5) is measured in relation to two horizontal axes deviating from each other. The measuring is performed with two inclinometers 8, 9 which measure the momentary total acceleration in relation to their measuring axis. The inclinometer, used as the sensors, gives measuring signals $x_1$ and $y_1$. The gyroscopic compass 10 of the ship gives the heading line h of the vessel. The cruising speed of the ship is obtained from the log sensor of the ship or from a positioning device 11 (for example, GPS).

Figure 5:
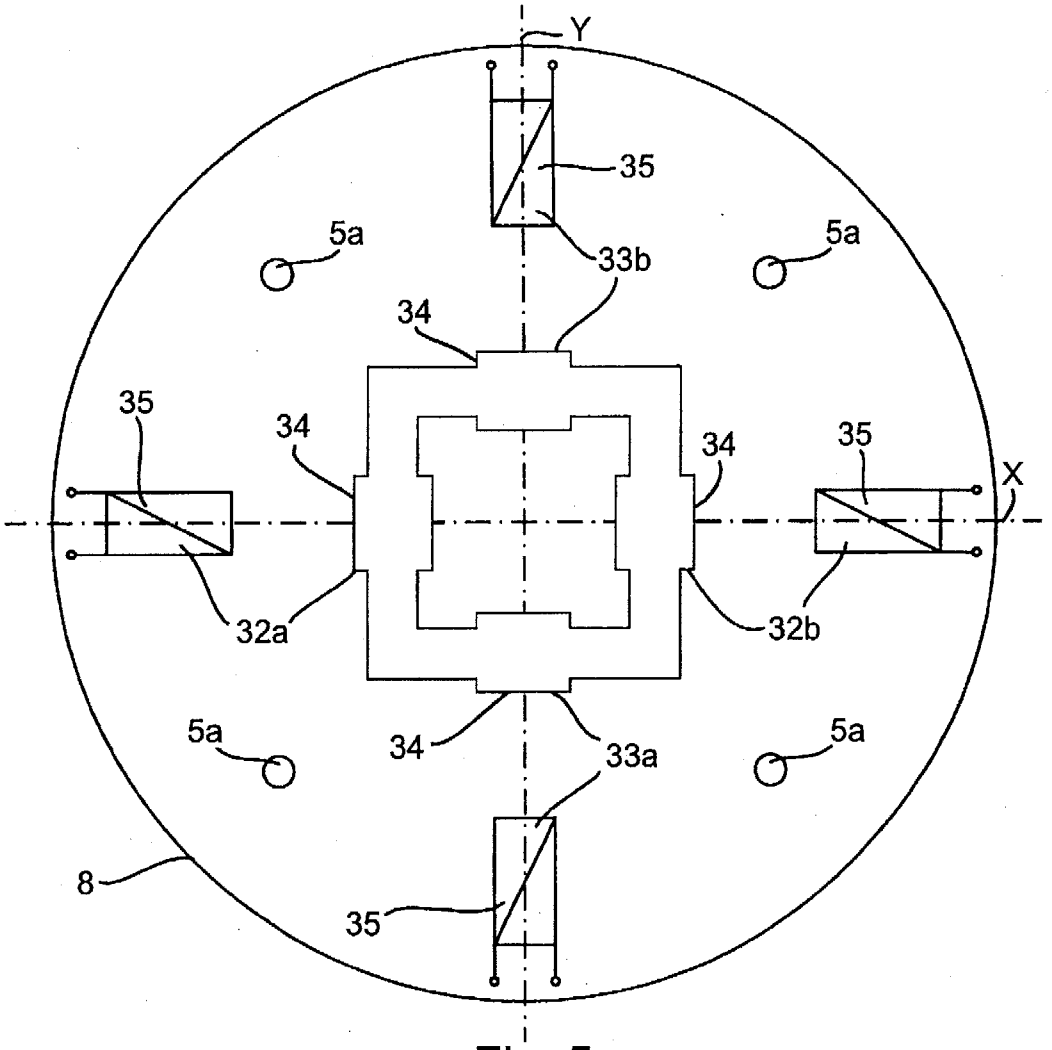
FIG. 5 is a cross-sectional view (line V—V) of FIG. 1 illustrating the utilization of an electromagnetic field for eliminating the effect of forces tending to change the position of the body on the contact-free principle.
Figure 6:
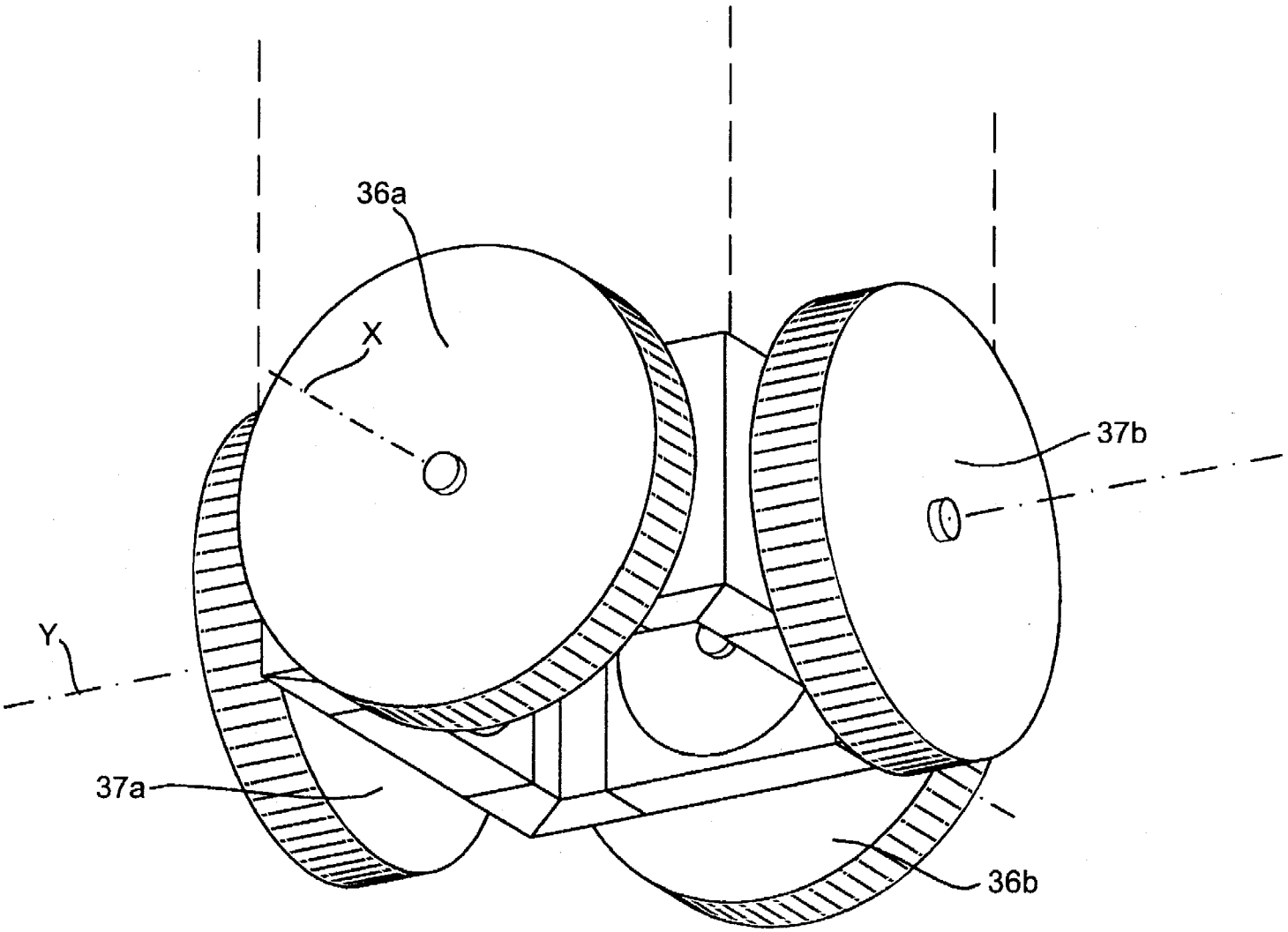
FIG. 6 illustrates the utilization of kinetic energy by a balancing wheel arrangement for eliminating the effect of forces tending to change the position of the body on the contact-free principle.

The measuring signal in the direction of the crosswise axis of the ship 5 is $x_1$ (inclinometer 8). If the antenna is not on the longitudinal axis of the ship 5, the signal is corrected with regard to deviations caused by accelerations due to changes in the heading line of the ship by adding (means 14) to the signal the square 12 of the angular velocity w derived from the heading line h, multiplied by the component $r_x$ (means 13) in the crosswise direction of the distance $r_1$ (FIG. 2). The new signal $x_2$ is corrected with regard to lateral accelerations caused by changes in the course of the ship by adding (means 15) thereto the angular velocity w of the ship's heading line multiplied by (means 16) the ship's velocity v. The signal $x_3$ thus obtained is passed through a low pass filter (means 17) with a long time constant adjusted (by means 18) to be a multiple of the cycle length of the frequency $f_1$ of the pitching movement of the vessel in the crosswise direction, whereby the effect of this pitching on the measuring result is minimized. The cycle length is obtained, for example, from the signal of the acceleration sensor (means 18) measuring the acceleration in the crosswise direction, or it is fixed as a constant on the basis of the properties of the ship. The low-pass filtered signal $x_4$ is fed to a regulator 19 controlling at least one actuator 20 functioning in direction X (FIGS. 4–6).

The measuring signal parallel to the heading line of the ship is $y_1$ (inclinometer 9). If the antenna is not on the crosswise axis of the ship, the deviations caused by the accelerations due to changes in the heading line of the ship are corrected in the signal $y_1$ by adding (by means 21) thereto the component $r_y$ (means 22) of the distance $r_1$ (FIG. 2) in the longitudinal direction of the ship, multiplied by the square of the angular velocity w derived from the heading line h. The corrected signal $y_2$ is corrected (by means 23) with regard to deviations caused by accelerations due to changes in the speed of the ship by adding thereto the acceleration $a_y$ derived (by means 24) from the velocity v. The signal $y_3$ obtained hereby is passed through a low pass filter (means 25) with a long time constant adjusted to be a multiple of the cycle length of the frequency $f_2$ of the pitching of the ship in the longitudinal direction, whereby the effect of this pitching on the measuring result is minimized. The cycle length is obtained, for example, from the measuring signal of the acceleration sensor (means 26) measuring the acceleration in the longitudinal direction, or it is fixed as a constant on the basis of the properties of the ship. The low-pass filtered signal $y_4$ is fed to a regulator 27 controlling at least one actuator 28 functioning in direction Y (FIGS. 4–6).

As actuators 20, 28, for example, four mechanical fans 20*a*, 20*b*; 28*a*, 28*b* are used (two in each direction X and Y) which are mounted in connection with the counterweight 3, at its lower part, as shown in FIG. 4. The control system, explained in connection with FIG. 3, controls the fans 20*a*, 20*b*; 28*a*, 28*b* in a way that the correction movement is started by directing the fans for a certain time. Upon approaching the desired position, the fans are directed to the opposite direction for a certain time, until the correcting movement is stopped. The ratio of these accelerating and decelerating times is controlled according to the D term of the PD regulator, that is the movement of the body is being stopped and further by the P term of the PD regulator, the time between the acceleration and the deceleration phases is adjusted (these actions being obvious concepts for a man skilled in the art, not described in this context). In the control system, the low-pass filtering of the measuring signal is taken into account by setting a decay time. Consequently, the fans are used to achieve forces effective on the body 1, 2, 7, 3 on reaction and/or collision principles.

The measuring signals $X_4$ and $Y_4$ obtained from the control system described above, particularly from its measuring system, result in the position data of the integrated body corrected with regard to lateral accelerations. The control system used can consist of analog means, using digital signal processing by a microprocessor, or a combination of these. The choice of components is part of the know-how of a man skilled in the art, and it is thus not described in more detail in this context.

It can be seen in FIG. 4 that the fans 20*a*, 20*b*; 28*a*, 28*b*used as actuators 6 are placed on the outer wall of the counterweight 3 in a way that both pairs are situated on the same line or direction X or Y with regard to the direction of movement of the air passing through the fans. In the embodiment shown in FIG. 4, as well as in FIGS. 5 and 6, the directions X and Y are arranged at right angles to each other. It is clear that also other angles are feasible between the directions, and this is even a necessity if there are more than two directions. The fans are placed in a framework 29 with a central opening 30 functioning as a passageway for the air flow through the fans either to the radome 8 and/or from the direction of the radome 8 towards the opening 30 and from there away from the connection of the counterweight 3 (see arrow 31, fan 20*a*).

It should be clear to a man skilled in the art that it is also possible to use only two fans, one in each direction X and Y. Further, it is clear that the direction of the flow of the fluidized medium through the fans can be altered.

FIG. 5 illustrates an embodiment of the invention using a principle analogous to that shown in FIG. 4. In this application, (four) pairs of electromagnetic means 32*a*, 32*b*; 33*a*, 33*b*, instead of forces caused by changes in the kinetic state of a fluidized medium (for example, air), are used as actuators 6 in directions X and Y (in pairs opposite each other acting in both directions X and Y). Each means of the pairs 32*a*, 32*b*; 33*a*, 33*b*is composed (for example, pair 32*a*, direction X in FIG. 5) of a permanent magnet 34 (first means) and an electromagnet 35 (second means) which is arranged in connection therewith for achieving a contact-free force. Particularly for simple control of the electric signals coming from the control system (FIG. 3), it is advantageous to fix the electromagnets 35 in connection with the support frame 5*a* and/or the radome 8 and the permanent magnets 34 at the corresponding point in the counterweight 3.

To a man skilled in the art, it is obvious that only one pair of means 34, 35 can be effective in the directions X and Y. The pairs of means can be placed in the lower part of the counterweight 3, as shown in FIG. 4.

FIG. 6 illustrates a perspective view of an embodiment of the invention based on utilizing kinetic energy. It consists of two pairs (in analogy to FIGS. 4 and 5) of balancing wheels 36*a*, 36*b*; 37*a*, 37*b*used as actuators 6, whose relative position and/or kinetic energy (speed of rotation) is changed to achieve a desired change in the position of the body.

Figure 7:
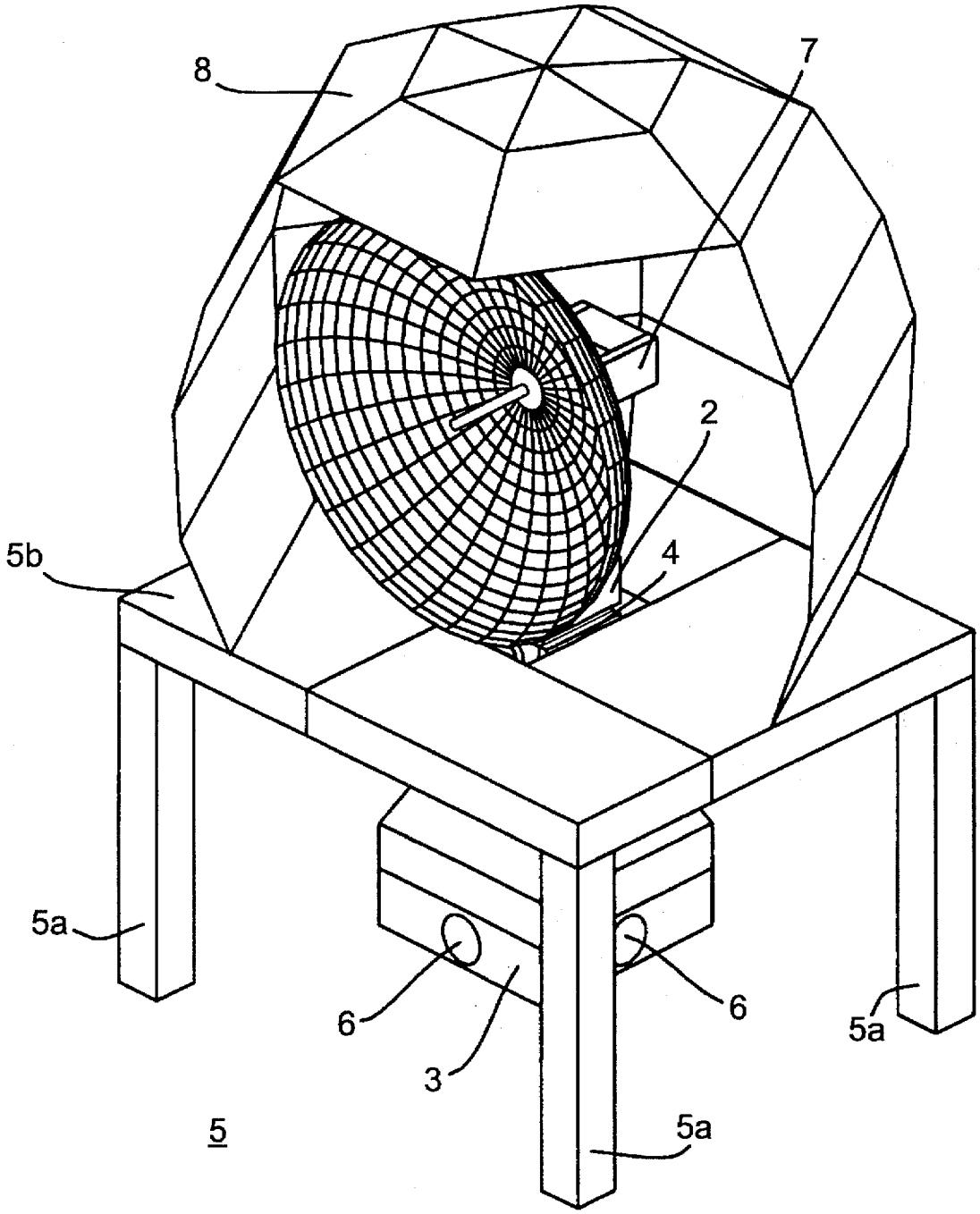
FIG. 7 shows a second embodiment modified of the illustration of FIG. 1.

In the embodiment shown in FIG. 7, the radome 8 is connected with a sublevel 5*b* being part of the elevated support frame 5*a*. The counterweight 3 is thus in free contact with fresh air between the ship's 5 deck and the sublevel 5*b*. Thus, for example, the embodiment shown in FIG. 4 can be modified in a way that, for example, water can be used as the fluidized medium, which is then removed along the deck of the ship 5.

From the presentation above, it is clear to a man skilled in the art that the invention is very diverse, containing several embodiments within the scope of the main idea of the invention. In particular, it should be noted that although the invention was illustrated in the above description by an application for a satellite antenna, the method can be applied in all uses where stabilization of a mechanical body is necessary. According to the invention, the forces induced on the contact-free principle can also be used in changing the position of the body in relation to the support frame and further after the said change for maintaining the position.

To summarize the invention, the method and the arrangement are based firstly on a stationary supported mass center of the body, secondly on continuous measurements of the kinetic state of the body, and thirdly on controlling the adjusting of the position of the body, especially by means of a slow control system.

I claim:

1. A method for stabilizing a position of an antenna body having a mass center and being supported on a support base moving in relation to an earth gravity field, comprising the steps of:

supporting said antenna body at its mass center located at a connection between said antenna body and said support base whereby any torque induced by inertial forces from accelerations on said antenna body is eliminated;

measuring a kinetic state of at least one of said antenna body and said support base, and generating forces, based on said measuring step, and acting on a contact-free principle, to maintain said antenna body in said position by removing effects of destabilizing forces.

2. A method according to claim 1 wherein said destabilizing forces are frictional forces.

3. A method according to claim 1 wherein said step of generating forces is accomplished by bringing a fluidized medium into a kinetic state.

4. A method according to claim 3 wherein said step of generating forces is accomplished using a plurality of fans.

5. A method according to claim 1 wherein said step of generating forces is accomplished by using an electromagnetic field.

6. A method according to claim 5 wherein said step of generating forces is accomplished by a plurality of pairs of electromagnetic means of which a first means in connected to said body and a second means is connected to a support frame.

7. A method according to claim 1 wherein said step of generating forces is accomplished by changing a relative position of a plurality of balancing wheels.

8. A method according to claim 1 wherein said step of generating forces is accomplished by changing speeds of rotation of a plurality of balancing wheels.

9. A method according to claim 1 further comprising the steps of:

forming said body as an integrated body, having an active body with a mass center and which is movable in relation to said support base, at least one counterweight connected with said active body, and means for maintaining said mass center of said active body in place during movement in relation to said at least one counterweight means, said maintaining means being at least partially in connection with said at least one counterweight means, supporting said integrated body by a support frame, and fixing said support frame to said support base at said mass center of said body.

10. A method according to claim 1 wherein said measuring step is accomplished by at least one sensor connected with said body, and further comprising the steps of:

sending a measuring signal from said at least one sensor to a slow control system, having a response rate at least one decade lower than a maximum kinetic velocity corresponding to said kinetic state of said support base, and forming a control signal in said slow control system for use in said step of generating forces.

11. A method for stabilizing a position of an antenna body having a mass center and being supported on a support base moving in relation to an earth gravity field, comprising the steps of:

supporting said antenna body at its mass center located at a gimbal joint connection between said antenna body and said support base whereby any torque induced by inertial forces from accelerations on said antenna body is eliminated, measuring a kinetic state of at least one of said antenna body and said support base by at least one sensor connected with said antenna body, conveying a measuring signal from said at least one sensor to a slow control system, having a response rate at least one decade lower than a maximum kinetic velocity corresponding to said kinetic state of said support base, forming a control signal in said slow control system, and generating forces with a set of devices, based on said control signal, to maintain said antenna body in said position by removing effects of destabilizing forces without said set of devices using physical contact with said support base to create said forces.

12. An apparatus for stabilizing a position of an antenna body having a mass center and being supported on a support base moving in relation to an earth gravity field, comprising:

an antenna body supported at its mass center located at a connection between said antenna body and said support base whereby any torque induced by inertial forces from accelerations on said antenna body is eliminated, means for measuring a kinetic state of at least one of said antenna body and said support base, and a set of devices in communication with said measuring means, for generating forces, acting on a contact-free principle, to maintain said antenna body in said position by removing effects of destabilizing forces.

13. An apparatus according to claim 12 wherein said destabilizing forces are frictional forces.

14. An apparatus according to claim 12 wherein said set of devices operates by bringing a fluidized medium into a kinetic state.

15. An apparatus according to claim 14 wherein said set of devices is a plurality of fans.

16. An apparatus according to claim 12 wherein said set of devices operates by generating an electromagnetic field.

17. An apparatus according to claim 16 wherein said set of devices is a plurality of pairs of electronic means of which a first means is connected to said body and a second means is connected to a support frame.

18. An apparatus according to claim 12 wherein said set of devices operates by changing a relative position of a plurality of balancing wheels.

19. An apparatus according to claim 12 wherein said set of devices operates by changing speeds of rotation of a plurality of balancing wheels.

20. An apparatus according to claim 12 wherein said body is an integrated body, supported by a support frame, comprising:

an active body, having a mass center and which is movable in relation to said support base;

at least one counterweight means connected with said active body, and means, at least partially in connection with said at least one counterweight means, for maintaining said mass center of said active body in place during movement in relation to said at least one counterweight means, wherein said support frame is fixed to said support base at said mass center of said body.

21. An apparatus according to claim 12 wherein said measuring means is at least one sensor connected with said body, and wherein said apparatus further includes:

a slow control system, for receiving a measuring signal from said at least one sensor and for forming a control signal for operating said set of devices, said slow control system having a response rate at least one decade lower than a maximum kinetic velocity corresponding to said kinetic state of said support base.

22. An apparatus for stabilizing a position of an antenna body having a mass center and being supported on a support base moving in relation to an earth gravity field, comprising an antenna body supported at its mass center located at a gimbal joint connection between said antenna body and said support base whereby any torque induced by inertial forces from accelerations on said antenna body is eliminated;

means for measuring a kinetic state of at least one of said antenna body and said support base;

a set of devices in communication with said measuring means, for generating forces to maintain said antenna body in said position by removing effects of destabilizing forces without said set of devices using physical contact with said support base to create said forces; and a slow control system, for receiving a measuring signal from said measuring means and for forming a control signal for operating said set of devices, said slow control system having a response rate at least one decade lower than a maximum kinetic velocity corresponding to said kinetic state of said support base.

* * * * *